US009359835B2

(12) United States Patent
Leman et al.

(10) Patent No.: US 9,359,835 B2
(45) Date of Patent: Jun. 7, 2016

(54) PIPE DRIVE SEALING SYSTEM AND METHOD

(71) Applicant: TESCO CORPORATION, Houston, TX (US)

(72) Inventors: Michael Everett Leman, Humble, TX (US); Ryan Thomas Bowley, Calgary (CA); Edgar Fernando Yajure, Calgary (CA); Doug Greening, Calgary (CA)

(73) Assignee: TESCO CORPORATION, Houston, TX (US)

( * ) Notice: Subject to any disclaimer, the term of this patent is extended or adjusted under 35 U.S.C. 154(b) by 707 days.

(21) Appl. No.: 13/655,798

(22) Filed: Oct. 19, 2012

(65) Prior Publication Data

US 2013/0168106 A1 Jul. 4, 2013

Related U.S. Application Data

(63) Continuation-in-part of application No. 13/339,161, filed on Dec. 28, 2011, now Pat. No. 9,175,524.

(51) Int. Cl.

| | |
|---|---|
| ***E21B 19/00*** | (2006.01) |
| ***E21B 19/07*** | (2006.01) |
| ***E21B 19/16*** | (2006.01) |

(52) U.S. Cl.

CPC ..... *E21B 19/00* (2013.01); *E21B 19/07* (2013.01); *E21B 19/161* (2013.01); *E21B 19/165* (2013.01)

(58) Field of Classification Search

CPC ..... E21B 19/00; E21B 19/07; E21B 19/161; E21B 19/165; E21B 19/08; E21B 19/086; E21B 19/16

See application file for complete search history.

(56) References Cited

U.S. PATENT DOCUMENTS

| | | | | |
|---|---|---|---|---|
| 4,867,236 | A * | 9/1989 | Haney | A41H 37/00 166/77.51 |
| 5,036,927 | A | 8/1991 | Willis | |
| 6,311,792 | B1 | 11/2001 | Scott et al. | |
| 6,679,333 | B2 * | 1/2004 | York | E21B 19/16 166/379 |
| 7,191,840 | B2 * | 3/2007 | Pietras et al. | 166/380 |
| 7,770,654 | B2 | 8/2010 | Beierbach et al. | |
| 7,854,265 | B2 | 12/2010 | Zimmermann | |
| 2004/0216924 | A1 * | 11/2004 | Pietras et al. | 175/57 |
| 2004/0256871 | A1 | 12/2004 | Leman et al. | |
| 2007/0193751 | A1 * | 8/2007 | Pietras et al. | 166/380 |

FOREIGN PATENT DOCUMENTS

| | | |
|---|---|---|
| EP | 0311455 | 4/1989 |

OTHER PUBLICATIONS

Warren Schneider, Casing Drive System drives safety, efficiency, E&P, Jan. 1, 2007.

Tesco Casing Drive System, Tesco Corporation, 2011.

International Search Report & Written Opinon for International Application No. PCT/US2013/065262 mailed Oct. 15, 2014.

* cited by examiner

*Primary Examiner* — Elizabeth Gitlin

(74) *Attorney, Agent, or Firm* — Fletcher Yoder, P.C.

(57) ABSTRACT

A pipe drive system includes a gripping device configured to couple with a pipe element. A housing of the gripping device is configured to extend over and at least partially around a distal end of the pipe element. Torsional clamp devices are configured to engage an outer circumferential surface of the pipe element with frictional engagement features that extend radially inward from the housing. A sealing mechanism is configured to shift a pipe seal relative to the housing and into engagement with the distal end of the pipe element and to facilitate fluid flow through the gripping device into the pipe element.

16 Claims, 13 Drawing Sheets

PIPE DRIVE SEALING SYSTEM AND METHOD

CROSS-REFERENCE TO RELATED APPLICATIONS

This application is a continuation-in-part of U.S. application Ser. No. 13/339,161 entitled "PIPE DRIVE SEALING SYSTEM AND METHOD", filed Dec. 28, 2011, which is hereby incorporated by reference.

BACKGROUND

Present embodiments relate generally to the field of drilling and processing of wells, and, more particularly, to a pipe drive system for coupling with and releasing drillpipe elements to facilitate insertion and removal of the drillpipe elements into and out of a wellbore during drilling operations and the like.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive to facilitate the act of drilling. As the drill string progresses down hole, additional drillpipe is added to the drill string.

During drilling of the well, the drilling rig may be used to insert joints or stands (e.g., multiple coupled joints) of drillpipe into the wellbore. Similarly, the drilling rig may be used to remove drillpipe from the wellbore. As an example, during insertion of drillpipe into the wellbore by a traditional operation, each drillpipe element (e.g., each joint or stand) is coupled to an attachment feature that is in turn lifted by a traveling block of the drilling rig such that the drillpipe element is positioned over the wellbore. An initial drillpipe element may be positioned in the wellbore and held in place by gripping devices near the rig floor, such as slips. Subsequent drillpipe elements may then be coupled to the existing drillpipe elements in the wellbore to continue formation of the drill string. Once attached, the drillpipe element and remaining drill string may be held in place by an elevator and released from the gripping devices (e.g., slips) such that the drill string can be lowered into the wellbore. Once the drill string is in place, the gripping devices can be reengaged to hold the drill string such that the elevator can be released and the process of attaching drillpipe elements can be started again. Similar procedures may be utilized for removing drillpipe from the wellbore.

Drillpipe is traditionally controlled during drilling using a screwed-in sub below the quill of a top drive. It is now recognized that certain aspects of these existing techniques are inefficient because of limitations on other procedural components during certain phases of operation.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
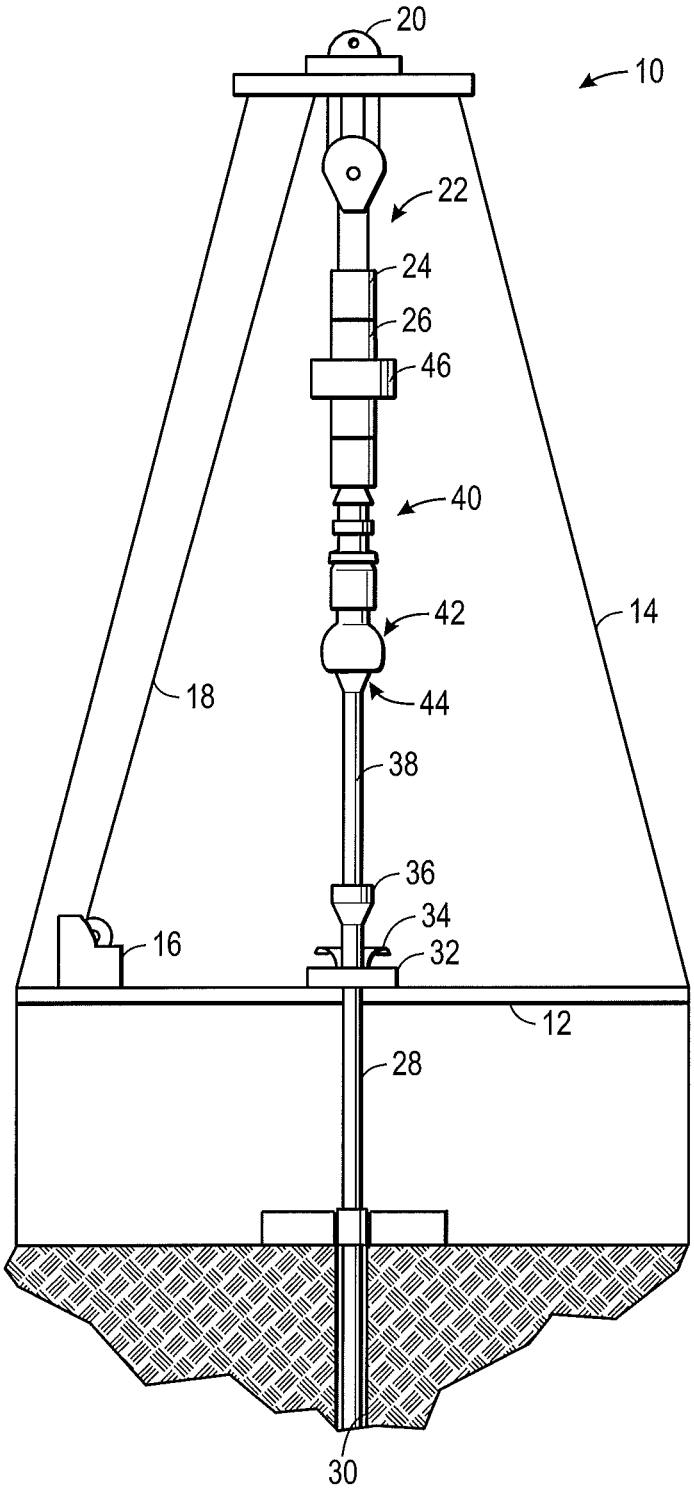
FIG. 1 is a schematic of a well being drilled in accordance with present techniques.

Present embodiments are directed to systems and methods for facilitating sealed engagement between drillpipe handling equipment (e.g., pipe drive systems or top drive systems) and drillpipe elements (e.g., joints or strings of drillpipe). For example, present embodiments include a gripping device that is integral with or configured to be coupled with a pipe drive system. A pipe drive system in accordance with present techniques may be used to facilitate assembly and disassembly of drill strings. Indeed, a pipe drive system may be employed to engage and lift a drillpipe element (e.g., a drillpipe joint), align the drillpipe element with a drill string, stab a pin end of the drillpipe element into a box end of the drill string, engage the drill string, and apply torque to make-up a coupling between the drillpipe element and the drill string. Thus, a pipe drive system may be employed to extend the drill string. Similarly, the pipe drive system may be used to disassemble drillpipe elements from a drill string by applying reverse torque and lifting the drillpipe elements out of the engagement with the remaining drill string. It should be noted that torque may be applied using a top drive system coupled to the pipe drive system or integral with the pipe drive system.

Each drillpipe element typically includes a pin end and a box end to facilitate coupling of multiple joints of drillpipe. When positioning and assembling drillpipe elements in the wellbore, a drillpipe element is typically inserted into the wellbore until only an upper end is exposed above the wellbore. This exposed portion may be referred to as a stump. At this point, slips are typically positioned about the stump near the rig floor to hold the drillpipe element in place. The box end is typically positioned facing upward ("box up") such that the pin end of subsequently inserted drillpipe with the pin facing downward ("pin down") can be coupled with the box end of the previously inserted drillpipe or stump to continue formation of the downhole string. Drillpipe being added may be gripped at a distal end by a pipe drive system and the opposite distal end may be stabbed into the box end of the stump. Next, the pipe drive system may be employed to make-up a coupling between the drillpipe being added and the stump. Once the newly added drillpipe is appropriately attached, the gripping member may be removed and the drill string lowered further into the wellbore using an elevator. This process continues until a desired length of the drill string is achieved. Similarly, a reverse process may be used during removal of a drill string from a wellbore.

During a process of installing or removing drillpipe elements, it may be desirable to circulate fluids (e.g., drilling mud) through the associated drill string. However, present embodiments may include gripping an outer portion of the drillpipe with the drillpipe handling equipment rather than attaching a sub via threaded engagement. For example, in accordance with present embodiments, an upper distal end of a drillpipe element being added may be gripped around its outer perimeter with drillpipe handling equipment without making-up an extension of the drillpipe handling equipment to threads of the distal end such that more rapid positioning of the drillpipe element is facilitated. This may result in an inability to flow fluids from the drillpipe handling system through the drillpipe element being added or the drill string during connection, disconnection, removal, or insertion phases of the process. Indeed, without an appropriately sealed connection between the drillpipe element and drillpipe handling equipment, at least a portion of the fluid proceeding through the drillpipe handling equipment will seek a path of least resistance and flow around the drillpipe element rather than through it. Thus, present embodiments include features to enable proper circulation of fluids during certain portions of the process. Indeed, present embodiments are directed to providing a seal between the drillpipe handling equipment and the drillpipe element such that fluid can efficiently pass from the pipe drive system into the drillpipe element.

Turning now to the drawings, FIG. 1 is a schematic of a drilling rig 10 in the process of drilling a well in accordance with present techniques. While FIG. 1 represents a drilling process, present embodiments may be utilized for disassembly processes and so forth. In particular, present embodiments may be employed in procedures including assembly or disassembly of drillpipe elements, wherein it is desirable to provide an amount of fluid circulation through the drillpipe elements from a drillpipe handling system during assembly or disassembly procedures. Furthermore, present embodiments may be used to provide fluid circulation for removing cuttings during drilling of the earth formation and for controlling the well.

In the illustrated embodiment, the drilling rig 10 features an elevated rig floor 12 and a derrick 14 extending above the rig floor 12. A supply reel 16 supplies drilling line 18 to a crown block 20 and traveling block 22 configured to hoist various types of equipment and drillpipe above the rig floor 12. The drilling line 18 is secured to a deadline tiedown anchor 24. Further, a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another drillpipe element or length of drillpipe 38 is in the process of being added.

The length of drillpipe 38 is held in place by a pipe drive system 40 that is hanging from the drawworks 26. Specifically, a gripping device 42 of the pipe drive system 40 is engaged about an outer perimeter of a distal end 44 of the drillpipe 38. This attachment via the gripping device 42 enables the pipe drive system 40 to maneuver the drillpipe 38. In the illustrated embodiment, the pipe drive system 40 is holding the drillpipe 38 in alignment with the stump 36. As will be discussed below, the gripping device 42 includes an integral seal or is configured to couple with the drillpipe 38 about a seal such that a sealed passage is established between the pipe drive system 40 and the drillpipe 38. Establishing this sealed passage facilitates circulation of fluid (e.g., drilling mud) through the pipe drive system 40 into the drillpipe 38 and the drill string 28. Further, the gripping device 42 couples with the drillpipe 38 in a manner that enables translation of motion to the drillpipe 38. Indeed, in the illustrated embodiment the pipe drive system 40 includes a top drive 46 configured to supply torque for making-up and unmaking a coupling between the drillpipe 38 and the stump 36. It should be noted that, in some embodiments, the top drive 46 is separate from the pipe drive system 40.

Figure 2:
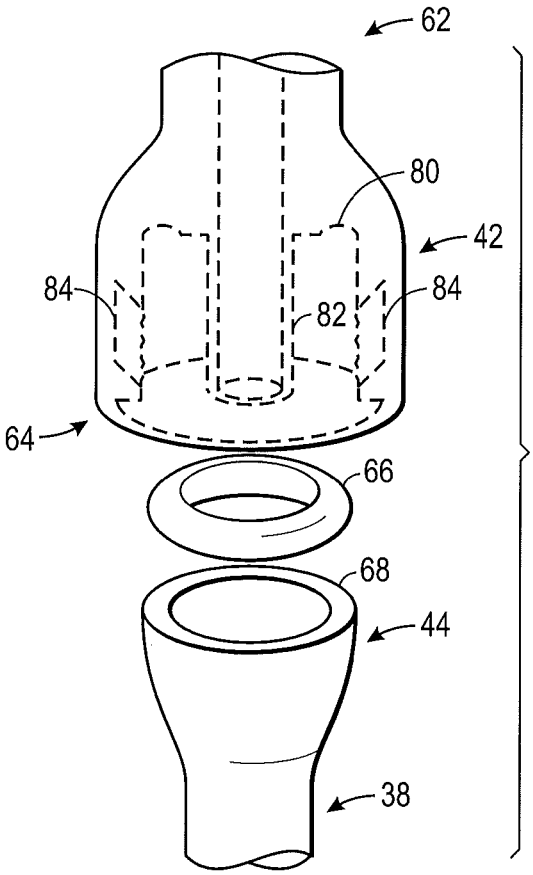
FIG. 2 is an exploded perspective view of a coupling between a gripping device and a drillpipe element in accordance with present techniques.

FIG. 2 is an exploded perspective view of a coupling between the gripping device 42 and the drillpipe 38 in accordance with present embodiments. Further, FIG. 2 illustrates a cross-sectional representation of certain internal components of the gripping device 42. Specifically, in accordance with the illustrated embodiment, the gripping device 42 includes a base end 62 and a drillpipe engagement end 64. The base end 62 may be integral with the pipe drive system 40 or it may include coupling features for attachment to the pipe drive system 40. The drillpipe engagement end 64 is configured to engage the distal end 44 of the drillpipe 38 such that a seal 66 is pressed between the gripping device 42 and a face 68 of the drillpipe 38 to create a sealed passage.

In the illustrated embodiment, the seal 66 is separate from the gripping device 42 and is held in position by the engagement of the gripping device 42 with the drillpipe 38. For example, the seal 66 may be designed to be disposable such that a new seal 66 may be utilized each time a different drillpipe 38 is coupled with the gripping device 42 or after a certain number of uses. Indeed, after one or more uses, the structure of the seal 66 and the material forming the seal 66 may become degraded such that the seal 66 ceases to function properly. In this case, an operator can simply obtain another disposable seal 66 and position it on the face 68 of the drillpipe 38 before lowering the gripping device 42 over the drillpipe 38. Facilitating frequent replacement of the seal 66 by employing disposable seals 66 substantially limits the functional requirements of the seal 66 in accordance with present techniques. In other embodiments, the seal 66 may be coupled directly to the gripping device 42 via adhesive, installment in a receptacle (e.g., a groove), or the like. Indeed, in some embodiments, the seal 66 may be imbedded or integral with the gripping device 42. For example, the seal 66 may be integrated with the gripping device 42 such that the gripping device 42 must be replaced when the seal is no longer functional. In embodiments wherein the seal is integrated with or embedded within the gripping device 42, the seal 66 may be designed to withstand long-term use. As an example, whether separate from or integral with the gripping device 42, the seal 66 may be formed from nitrile rubber and may be designed to withstand pressures ranging from 1,000 psi to 6,000 psi on the surface area of the seal 66.

Internal features of the gripping device 42 include a device face 80, a filler neck 82 extending from the device face 80, and engagement features 84. The device face 80 of the gripping device 42 is configured to abut the seal 66 such that the seal 66 is pressed between the device face 80 and the drillpipe face 68 of the distal end 44 of the drillpipe 38 when the gripping device 42 is properly coupled with the drillpipe 38. Such a coupling may be achieved by aligning the device face 80, the seal 66, and the drillpipe face 68 and then setting the gripping device 42 down on top of the drillpipe seal 66 and drillpipe 38. The weight of the pipe drive system 40, which may include the weight of the top drive 46 may assist in creating a 1,000 to 6,000 pound seal. In some situations, even higher seal pressure may be achieved. Indeed, the top drive 46 alone may weigh as much as 15 tons or more. As will be discussed below, once established, this seal may be maintained by coupling the gripping device 42 to the drillpipe 38 via the engagement features 84. Further, the activated seal may prevent flow of fluids outside of the drillpipe 38 and across other features of the gripping device 42, such as the engagement features 84, which can be degraded quickly by fluids used for circulation.

After or during establishment of such a compressive seal, the engagement features 84 (e.g., frictional engagement slips) may be actuated to maintain the coupling between the gripping device 42 and the drillpipe 38. For example, the engagement features 84 may be hydraulically, mechanically, electronically or otherwise actuated to radially engage a circumferential area of the drillpipe 38 by a control feature or the engagement features 84 may be automatically actuated in a radial direction based on the downward force applied by setting the gripping device 42 down on the seal 66 and the drillpipe face 68. Indeed, various mechanisms may be utilized to facilitate a frictional coupling between the outer circumferential area of the drillpipe 38 and the engagement features 84. The engagement features 84 generally include a textured surface that facilitates frictional engagement with the drillpipe 38 such that the gripping device 42 can be utilized to lift the drillpipe 38 and such that rotational movement is readily translated from the gripping device 42 to the drillpipe 38. Those having ordinary skill in the art will appreciate that the sealing features in accordance with present embodiments are independent of the manner in which the gripping of the drill pipe 38 is actuated and achieved.

Further, the process of coupling the gripping device 42 with the drillpipe 38 includes slidably positioning the filler neck 82 within the drillpipe 38. The filler neck 82 is sufficiently sized to fit within the inside diameter of one or more different types of drillpipe. Due to the shape and positioning of the filler neck 82 with respect to the gripping device 42, this engagement occurs as a result of positioning the gripping device 42 over the drillpipe 38. Indeed, the filler neck 82 may essentially guide such an engagement by extending into the drillpipe 38. Although shown as cylindrical, the filler neck 82 may be conical or otherwise shaped to avoid hanging up on the threads 118. Thus, a flow path extending through the pipe drive system 40 is extended into the drillpipe 38 via the filler neck 82, which facilitates fluid circulation from the pipe drive system 40 into the drillpipe 38 and any coupled drill string. In some embodiments, the filler neck 82 may be excluded. However, it may be beneficial to include the filler neck 82 for reducing back flow and resisting the washing of fluid across the connection. That is, the filler neck 82 may function to reduce wear or washout of the seal 66 and other features of the system. For example, it may be desirable for the filler neck 82 to be of sufficient length to extend past the threads of the distal end 44 of the drillpipe 38 to reduce wear on the threads, reduce wear on the seal 66, and generally encourage flow into the drillpipe 38 and any associated drill string.

Figure 3:
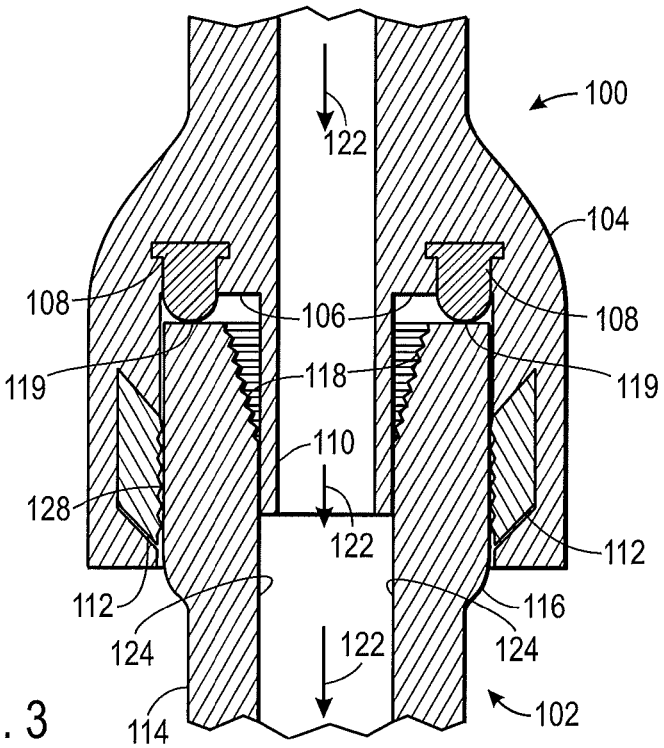
FIG. 3 is a schematic cross-sectional view of a gripping device with an integral seal and a drillpipe element in accordance with present techniques.

FIG. 3 is a schematic cross-sectional view of a gripping device 100 in the process of being coupled with a drillpipe element 102 in accordance with embodiments of the present technique. In the illustrated embodiment, the gripping device 100 includes a housing 104, a coupling device or housing face 106, an integral seal 108, a filler neck 110, and engagement pads 112 (also known in the art as "slips"). The drillpipe element 102 includes a drillpipe body 114, a tool joint 116, threads 118, and a drillpipe face 119.

Specifically, the arrangement of the gripping device 100 and the drillpipe element 102 illustrated by FIG. 3 represents the gripping device 100 being set down on the drillpipe element 102 such that, as generally discussed above, pressure or force (e.g., the weight of a top drive or pipe drive system) is applied to the integral seal 108 via the gripping device 100 and the drillpipe element 102. This force or pressure causes deformation of the integral seal 108 and establishment of a pressurized seal in a seal area between a flow path 122 through the gripping device 100 and drillpipe element 102, and areas outside of the flow path 122.

The flow path 122 includes the filler neck 110, which extends into the drillpipe element 102. While embodiments in accordance with the present techniques may not include such a feature, the illustrated embodiment includes the filler neck 110 to direct fluid flow past the threads 118 of the drillpipe element 102 and past the integral seal 108. Indeed, when fully inserted, the filler neck 110 is of sufficient length to extend past the integral seal 108 and past the threads 118 to limit interaction of circulation fluid with these components. Further, the filler neck 110 is sized such that it has limited clearance between the walls of the 124 drillpipe element 102, which creates resistance to back flow of the fluid towards the threads 118 and integral seal 108. The inclusion and sizing of the filler neck 110 will thus resist degradation of features of the gripping device 100 and drillpipe element 102 due to washout and so forth.

In the illustrated embodiment, the engagement pads 112 have not yet engaged with the outer circumferential area of the drillpipe element 102. However, once the pressurized seal is established to a desired degree, the engagement pads 112 may be actuated to radially engage an exterior of the drillpipe element 102. In some embodiments, the engagement pads 112 may be radially actuated by pushing them up or down with respect to an axis of the gripping device 100 such that they slide along a ramp that presses the engagement pads 112 radially inward to engage the drillpipe element 102. This actuation may be achieved in various manners, such as hydraulically or based on frictional engagement with the drillpipe element 102. For example, sliding the drillpipe element 102 between the engagement pads 112 may cause the engagement pads 112 to slide upwards against a ramp that pushes the engagement pads 112 radially inward. In another embodiment, the engagement pads 112 may be pressed radially inward without any vertical sliding motion. Indeed, various different actuation techniques and engagement features may be utilized in accordance with present embodiments.

In the illustrated embodiment, patterns 128 on the surface of the engagement pads 112 are configured to function as wickers and may be pressed into contact with the outer circumferential area of the tool joint 116 to establish a frictional coupling between the gripping device 100 and the drillpipe element 102. The patterns 128 may be arranged to provide resistance to movement in multiple directions once engaged. For example, the patterns 128 may include upwardly angled teeth and teeth aligned with an axis of the drillpipe element 102 such that rotational and lifting motions are efficiently imparted to the drillpipe from the gripping device 100. In this way, force from a top drive coupled to the gripping device 100 can be utilized to lift or rotate the drillpipe 102 during an assembly or disassembly process.

Figure 4:
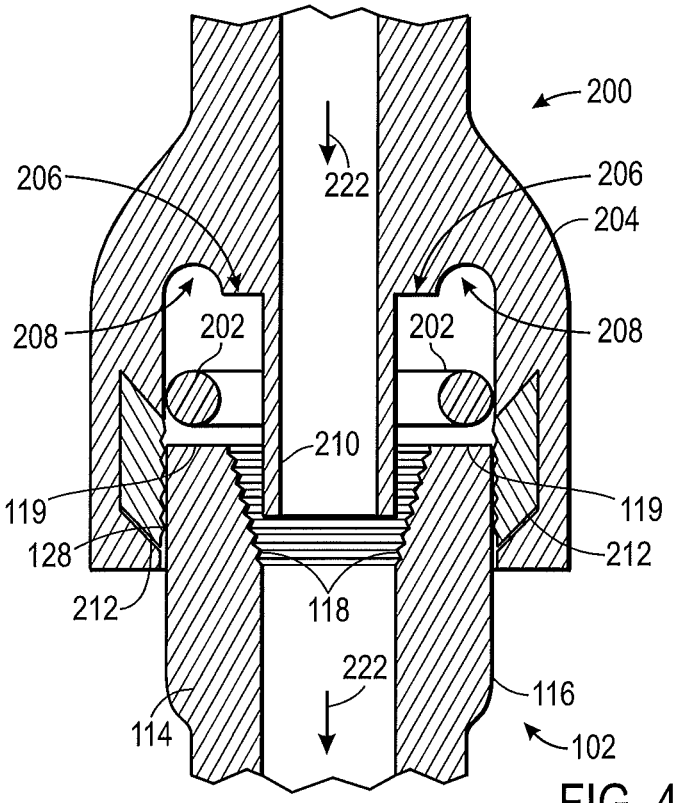
FIG. 4 is a schematic cross-sectional view of a gripping device, a separate seal, and a drillpipe element in accordance with present techniques.

FIG. 4 is a schematic cross-sectional view of a gripping device 200 in the process of being coupled with the drillpipe element 102 about a separate seal 202 in accordance with embodiments of the present technique. In the illustrated embodiment, the gripping device 200 includes a housing 204, a coupling device or housing face 206, a seal groove 208, a filler neck 210, and engagement pads 212. As discussed above, the drillpipe element 102 includes the drillpipe body 114, the tool joint 116, the threads 118, and the drillpipe face 119.

Specifically, the arrangement of the gripping device 200 and the drillpipe element 102 illustrated by FIG. 4 represents the gripping device 200 being set down on the drillpipe element 102 after the separate seal 202 has been positioned on the drillpipe face 119. As generally discussed above, once the separate seal 202 is abutting the housing face 206 and the drillpipe face 119 within a seal area, pressure or force (e.g., the weight of a top drive or pipe drive system) may be applied to cause deformation of the separate seal 202. Thus, the separate seal 202 is utilized to establish a pressurized seal between a flow path 222 through the gripping device 200 and drillpipe element 102, and areas outside of the flow path 222.

In the illustrated embodiment, the housing face 206 includes the seal groove 208, which is formed to provide a receptacle for the separate seal 202. In the illustrated embodiment, the separate seal 202 has been positioned on the drillpipe face 119 such that when it engages with the housing face 206, the separate seal 202 will be pressed into the seal groove 208. In other situations, the separate seal 202 may be initially installed within the seal groove 208 before coupling the gripping device 202 with the drillpipe element 102. Including a receptacle such as the seal groove 208 may stabilize the separate seal 202 and provide additional seal integrity. However, in some embodiments, the housing face 206 may not include the seal groove 208 or any type of receptacle for the separate seal 208. Rather, in some embodiments, the housing face 206 may be substantially flat and/or textured for engagement with the separate seal 202 such that it can be pressed between the housing face 206 and the drillpipe face 119.

Other aspects of the gripping device 200 illustrated in FIG. 4 are similar to those of the gripping device 100 illustrated in FIG. 3. For example, when the flow path 222 is established by coupling the gripping device 200 with the drillpipe element 102, the flow path 222 includes the filler neck 210, which extends into the drillpipe element 102. Further, as with the embodiment illustrated in FIG. 3, the engagement pads 212 illustrated in FIG. 4 have not yet engaged with the outer circumferential area of the drillpipe element 102. However, once the pressurized seal is established to a desired degree, the engagement pads 112 may be actuated to radially engage an exterior of the drillpipe element 102 such that patterns or wickers 228 of the engagement pads 112 frictionally grip the drillpipe element 102, or more specifically the tool joint 116 portion of the drill pipe element 102.

Figure 5:
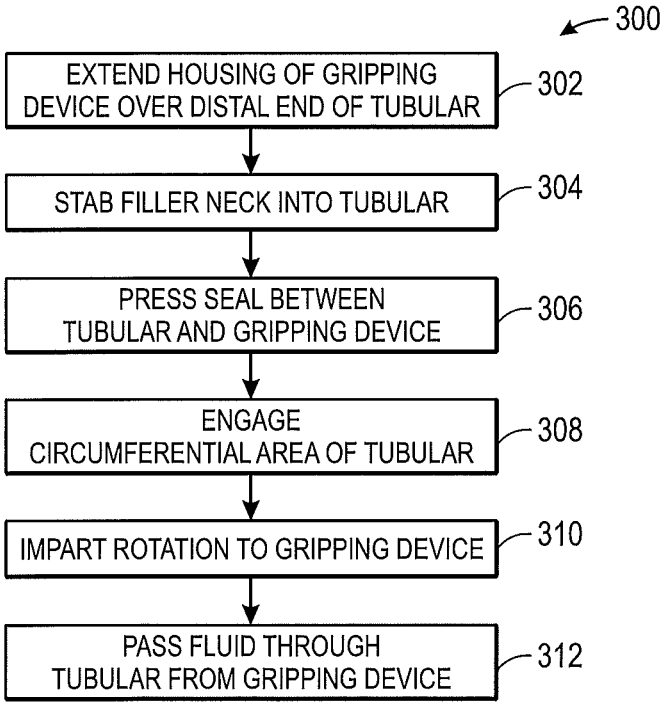
FIG. 5 is a process flow diagram of a method in accordance with present techniques.

FIG. 5 is a process flow diagram of a method of assembling or disassembling a drill string in accordance with present techniques. The method is generally indicated by reference numeral 300 and includes blocks that are representative of various steps or acts in the method 300. It should be noted that the various steps of the method 300 can be performed in the illustrated order or in a different order in accordance with present techniques. Further, in some instances, certain steps illustrated in FIG. 5 may be eliminated or additional steps may be performed.

As represented by block 302, the method 300 begins with extending a housing of a gripping device over a distal end of a drillpipe element such that a boundary of the housing extending from a perimeter of a face of the gripping device surrounds a circumferential area of the drillpipe element. As represented by block 304, this may result in stabbing a filler neck into the drillpipe element, wherein the filler neck extends from an inner perimeter of the face of the gripping device. Next, as represented by block 306, the method 300 includes pressing a seal between the face of the gripping device and a face of the drillpipe element. The seal may be integral with the gripping device or this may include the act of placing the seal between the gripping device and the drillpipe element. Further, block 308 represents engaging the circumferential area of the drillpipe element with an engagement feature of the gripping device. The step represented by block 308 may include hydraulically actuating gripping pads. Block 310 represents rotating the gripping device to impart rotation to the drillpipe element to facilitate attachment or detachment of the drillpipe element with a drill string. Further, block 312 represents passing fluid through the filler neck into the drill string.

Present embodiments may provide the advantages of a relatively simple, reliable, and inexpensive seal between the surface equipment on the drilling rig and a string of drill pipe without the need to make-up a threaded connection. In one embodiment, the seal could be an elastomeric ring, such as urethane, nitrile or butyl rubber, that is pressed between the sealing surface within the gripping device and the upward facing surface of the drill pipe. The seal's pressure capability is substantially dependent, if not proportional, to squeeze applied to the seal. The weight of the gripping device and other surface equipment, such as the top drive, is typically over 20,000 lbs., if not several times that weight. Most of the surface equipment weight can be applied towards squeezing the seal, which should easily withstand fluid pressures typical of drilling operations. This simplified, somewhat "brute force," method of sealing allows for wide dimensional and surface finish tolerances because the squeezed seal will simply form itself to the surfaces between which the seal is squeezed. The ability to seal against surface imperfections is useful because the drill pipe is handled roughly during drilling operations, which leads to gouges and scratches on the face of the tool joint. Because the simple shapes (e.g., cylindrical or O-ring) and relatively cheap elastomers that may be used for the seal, the seals may even be treated as disposable without adding significantly to the costs of the drilling operation.

In some embodiments, rather than moving a drillpipe and/or a gripping device with respect to one another to achieve a sealing engagement between the drillpipe and gripping component, the gripping device may include features for holding the drillpipe in place and mechanically engaging a sealing feature of the gripping device with the drillpipe. For example, FIGS. 6 and 7 include a side view and a cross-sectional view, respectively, of a gripping device 400 in the process of being coupled with the drillpipe element 102 in accordance with embodiments of the present technique. It should be noted that the cross-sectional view presented in FIG. 7 is taken along line 6A-6A of FIG. 6, which is essentially along a rotational axis of the gripping device 400. In particular, FIGS. 6 and 7 may represent the drillpipe element 102 being lifted into engagement with the gripping device 400 or the gripping device 400 being lowered over the drillpipe element 102. The gripping device 400 includes various pipe gripping features and a hydraulically energized piston that moves within the gripping device 400 and seals against the drillpipe element 102, as will be discussed in detail below. As in FIGS. 3 and 4, the drillpipe element 102 includes the drillpipe body 114, the tool joint 116, the threads 118, and the drillpipe face 119. The drillpipe element 102 may simply be representative of a tubular element and present embodiments may be configured to couple with other tubular elements.

Figure 6:
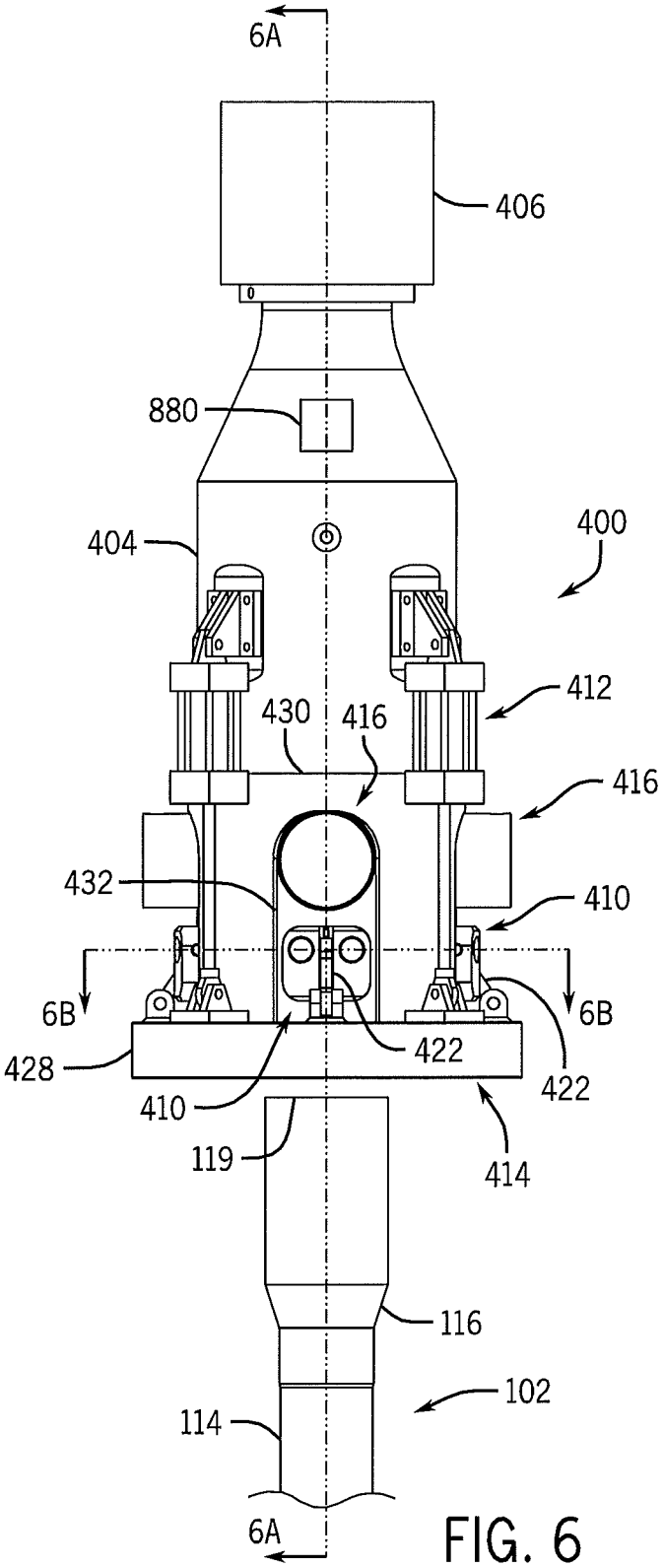
FIG. 6 is a side view of a gripping device and a drillpipe element, wherein the gripping device is in a refracted orientation in accordance with present techniques.
Figure 7:
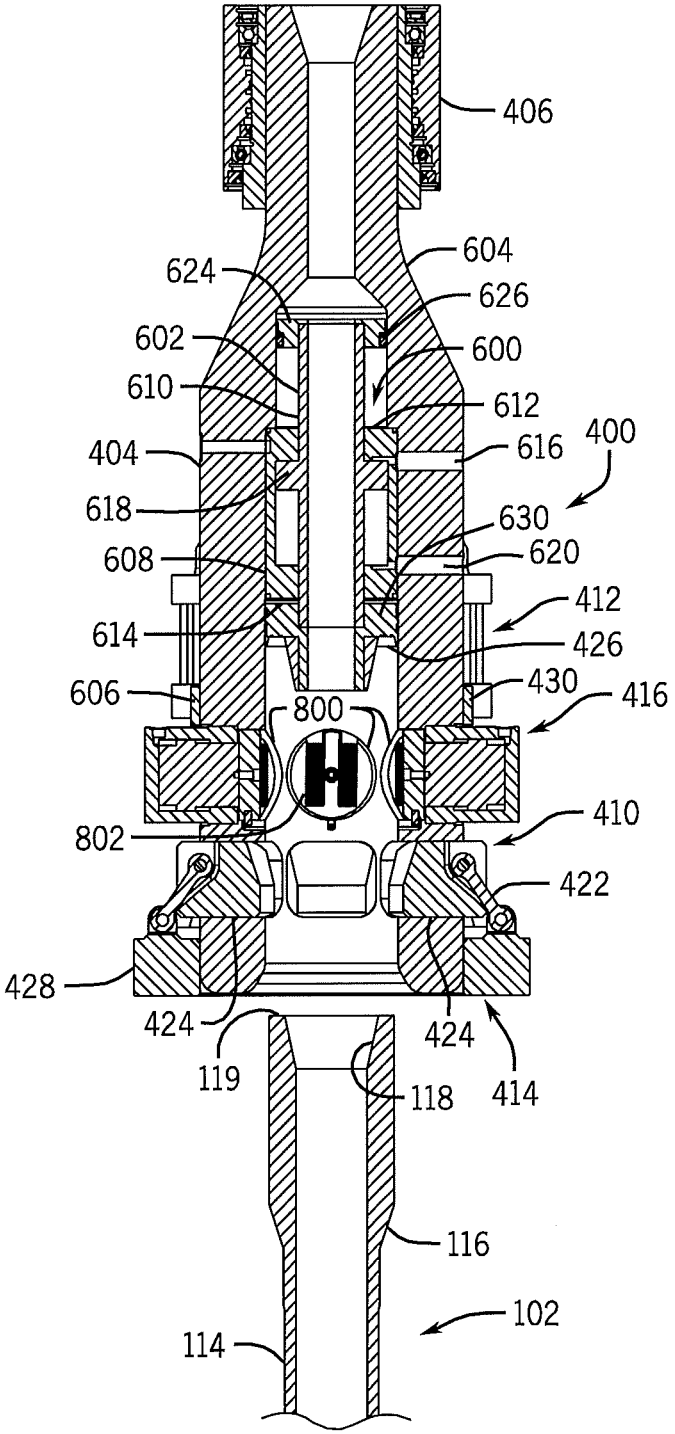
FIG. 7 is a cross-sectional view of the gripping device and drillpipe element of FIG. 6 taken along line 6A-6A in accordance with present techniques.

In the embodiment illustrated by FIGS. 6 and 7, the gripping device 400 includes various features that are at least partially visible from the outside of the gripping device 400. Specifically, for example, the gripping device 400 includes a main body or housing 404, a hydraulic rotary seal 406 coupled about an end of the housing 404, elevators 410, elevator actuators 412, an elevator support or lock 414, and torsional clamping actuators 416. As will be discussed below, these features cooperate together to facilitate surrounding a distal end of the drillpipe element 102, vertically securing the drillpipe element 102 within the griping device 400, creating a sealed engagement between the gripping device 400 and the drillpipe element 102, centralizing the drillpipe element 102 within the gripping device 400, and applying torque to the drillpipe element 102 via the gripping device 400. The manner in which these features may function will be discussed in detail below.

Present embodiments are directed to establishing an engagement between the gripping device 400 and the drillpipe element 102 that can support a pulling load, a torsional load, and a fluid seal (e.g., mud seal). An initial aspect of establishing such an engagement between the drillpipe element 102 and the gripping device 400 includes engaging the tool joint 116 with the elevators 410 to support a pulling load. In some embodiments, this includes positioning the tool joint 116 within the gripping device 400. For example, in the illustrated embodiment, the elevators 410 are integral with the gripping device 400. However, in other embodiments, separate elevator features may be used along with a linkage or the like to secure the drillpipe element 102 with respect to a gripping device in accordance with present embodiments.

In the illustrated embodiment, the elevators 410 include links 422 and elevator blocks 424. The links 422 translate vertical motion into horizontal or radial motion and the elevator blocks 424 function to engage and secure the drill pipe element 102 within the gripping device 400. Specifically, as the elevator support 414 moves up or down relative to the housing 404, the corresponding movement of the elevators 410 causes the links 422 to push or pull the elevator blocks 424 through openings in the housing 404 such that the elevator blocks 424 can engage or disengage the tool joint 116. As can be more readily observed in FIG. 7, the actuation state of the gripping device 400 illustrated in FIGS. 6 and 7 includes the elevator blocks 424 in a retracted position. Indeed, the elevator blocks 424 are generally retracted outside of the internal diameter of the housing 404. When the elevator blocks 424 are in this refracted position, the drillpipe 102 can readily slide past the elevator blocks 424 into the housing 404. When the elevator blocks 424 are in the engaged position, the elevator blocks 424 engage the tool joint 116. More specifically, the elevator blocks 424 engage the upset or conical portion of the tool joint 116, which enables support of the pulling load by the gripping device 400 without creating a threaded engagement between the threads 118 and any feature of the gripping device 400.

When initially coupling the drillpipe 102 and the gripping device 400, the drillpipe 102 and gripping device 400 may first be engaged such that the tool joint 116 is positioned within the gripping device 400 and positioned beyond the elevator blocks 424 to some degree. Once the tool joint 116 has generally progressed beyond edges of the elevator blocks 424, the elevator actuators 412 may actuate the elevators 410 to engage the elevator blocks 424 with the drillpipe 424. For example, to establish proper alignment of the elevator blocks 424 and the tool joint 116, the drillpipe face 119 and a seal face 426 within the housing 404 may be slid into engagement. The seal face 426 may be arranged within the housing 404 based on standard tool joint sizes such that engagement of the drillpipe face 119 with the seal face 426 ensures that the tool joint 116 is properly positioned with respect to the elevator blocks 424 before activation of the elevators 410. Once a desired positioning is achieved, the elevators 410 may be actuated to engage the tool joint 116 and thus establish vertical or pulling support of the drillpipe 102 by the gripping device 400.

The elevator actuators 412 may include hydraulically actuated cylinders that may be activated to move the elevator support 414 toward the hydraulic rotary seal 404 and, in turn, actuate the elevators 410. In the illustrated embodiment, the elevator support 414 includes a base ring 428 and a sleeve 430 that is disposed around the outer perimeter of housing 404. The sleeve 430 provides support and includes slots 432 to facilitate movement of the sleeve 430 about the portions of the elevators 410 and torsional clamping actuators 416 that extend from the perimeter of the housing 404. The base ring 428 provides a base for attachment of the links 422 and operates as a locking feature when the elevators 410 are fully engaged. In the illustrated embodiment, the elevator actuators 412 are configured to cause the elevator support 414 to move upward toward the hydraulic rotary seal 40. When the elevator support 414 moves up, a portion of the links 422 attached to the base ring 428 are moved upward as well, which causes the links 422 to push the elevator blocks 424 through openings in the housing 404 into an extended or engaged orientation. When the drillpipe 102 is properly positioned within the gripping device 400, putting the elevators 410 in the extended orientation results in engagement of the elevator blocks 424 with the tool joint 116.

Figure 8:
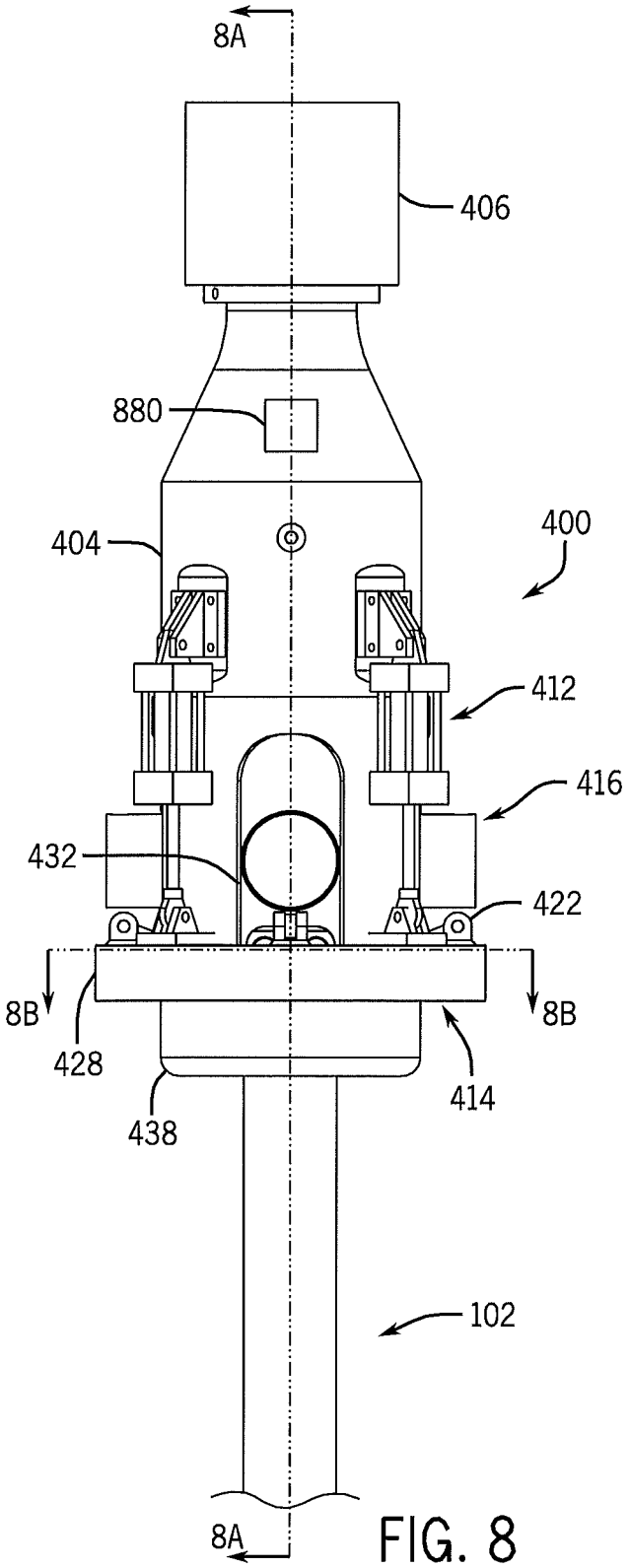
FIG. 8 is a side view of a gripping device and a drillpipe element, wherein the gripping device is in an engaged orientation in accordance with present techniques.
Figure 9:
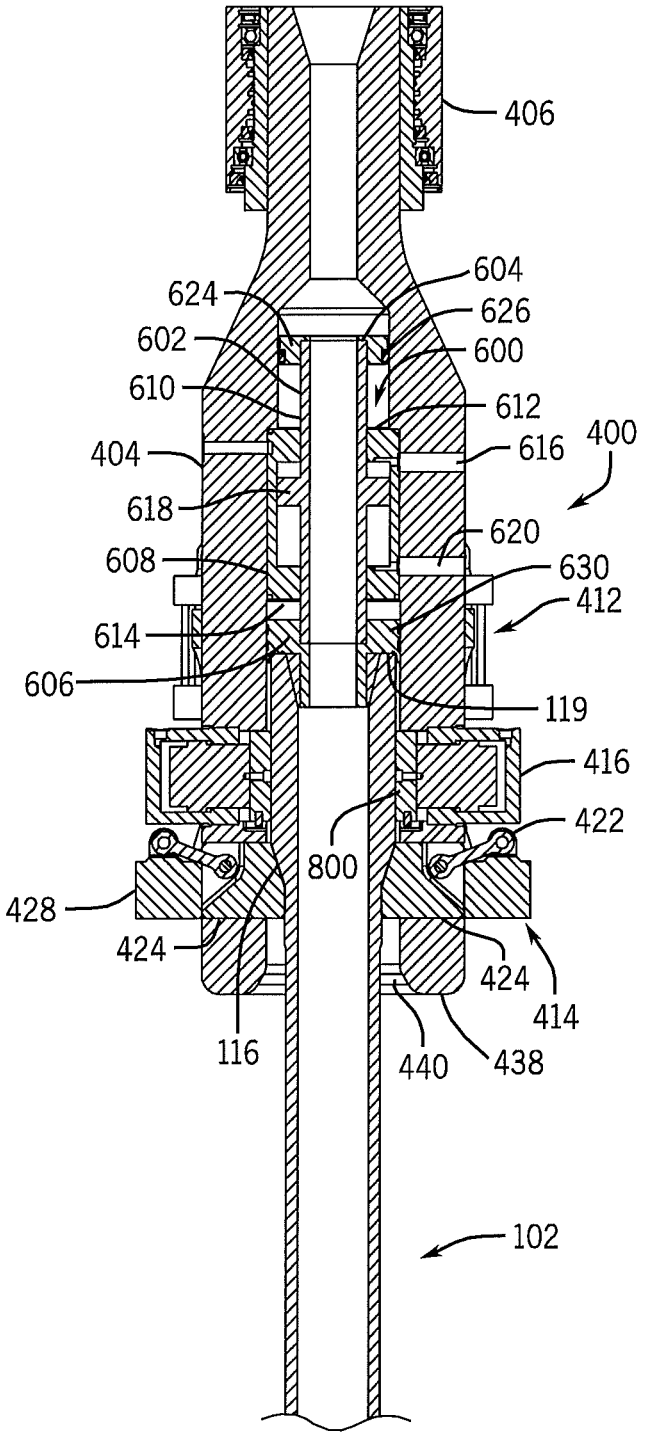
FIG. 9 is a cross-sectional view of the gripping device and drillpipe element of FIG. 8 taken along line 8A-8A in accordance with present techniques.

The extended or engaged orientation of the elevators 410 is illustrated in FIGS. 8 and 9, which include a side view and a cross-sectional view, respectively, of the gripping device 400 while engaged with the drillpipe element 102. FIG. 9 is a cross-sectional view of the gripping device 400 taken along line 8A-8A in FIG. 8. As shown in FIG. 8, the elevator support 414 has been moved upward along the housing 404 toward the hydraulic rotary seal 406. The movement of the elevator support 414 with respect to the housing is evidenced by the change in position of the slots 432 with respect to the torsional clamping actuators 416 and the exposure of a lower lip 438 of the housing 404 (which includes an internal taper 440 to facilitate insertion of the drillpipe element 102). Further, this repositioning of the elevator support 414 results in the base ring 428 of the elevator support 414 being positioned around the elevator blocks 424 such that the base ring 428 retains the elevator blocks 424 in the extended position within the internal diameter of the housing 404. Thus, when the gripping device 400 is coupled with the drillpipe element 102, the base ring 428 keeps the elevators 410 engaged and prevents dropping the drillpipe element 102.

Figure 10:
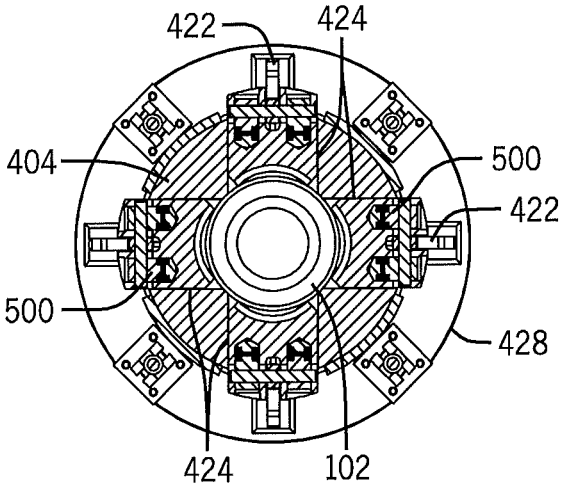
FIG. 10 is a cross-sectional view of the gripping device of FIG. 6 taken along line 6B-6B in accordance with present techniques.
Figure 11:
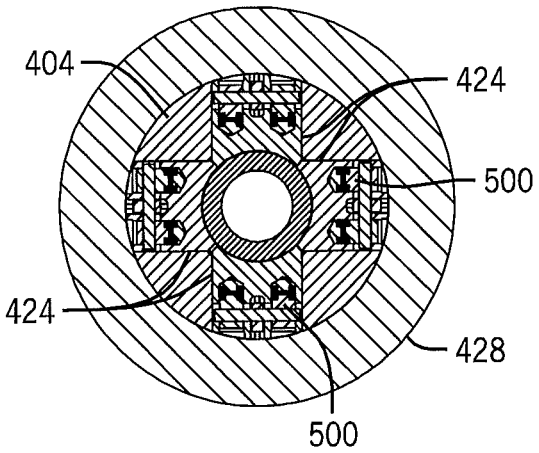
FIG. 11 is a cross-sectional view of the gripping device and drillpipe element of FIG. 8 taken along line 8B-8B in accordance with present techniques.

FIGS. 10 and 11 are cross-sectional views of the gripping device 400 taken along lines 6B-6B and 8B-8B, respectively. Each of these cross-sectional views are taken along lines passing through the elevators 410 and show the transition of the elevators 410 with respect to the gripping device 400 being in an open configuration (FIG. 10) and in an engaged configuration (FIG. 11). The inside diameter of the housing 404 is essentially unencumbered in FIG. 10 because the elevator blocks 424 are in a retracted position, while the elevator blocks 424 are partially positioned within the inside diameter of the housing 404 and are engaged with the drillpipe element 102 in the engaged configuration of FIG. 11. Further, in FIG. 10, the base ring 428 is shown below the elevator blocks 424 because the elevator support 414 has not yet been raised into a position surrounding the elevator blocks 524, while FIG. 11 shows the base ring aligned with the elevator blocks 424. It should also be noted that biasing mechanisms 500 of the elevators 410 are visible in each of the cross-sectional views provided by FIGS. 10 and 11. As will be discussed in detail below, these biasing mechanisms 500 may facilitate proper positioning of the elevator blocks 424 for engagement of the drillpipe element 102 and maintaining engagement between the gripping device 400 and the drill pipe element 102 under certain conditions.

As noted above, present embodiments may include features configured to maintain engagement of the elevator blocks 424 with the drillpipe element 102 (e.g., via the tool joint 116). Even in embodiments wherein the elevator actuators 412 require activation (e.g., via application of hydraulic pressure) to actuate the elevators 410, present embodiments may prevent the loss of activation energy (e.g., loss of hydraulic pressure) from causing the elevators 410 to disengage the drillpipe element 102. For example, the elevators 410 and the base ring 428 of the elevator support 414 may cooperate in an engaged orientation of the gripping device 400 to maintain coupling with the drillpipe element 102. Such cooperation is illustrated in FIG. 12, which includes a cross-sectional view of the elevator 410 including the biasing mechanism 500, wherein the elevator block 424 is aligned with and positioned inside of the base ring 428.

Figure 12:
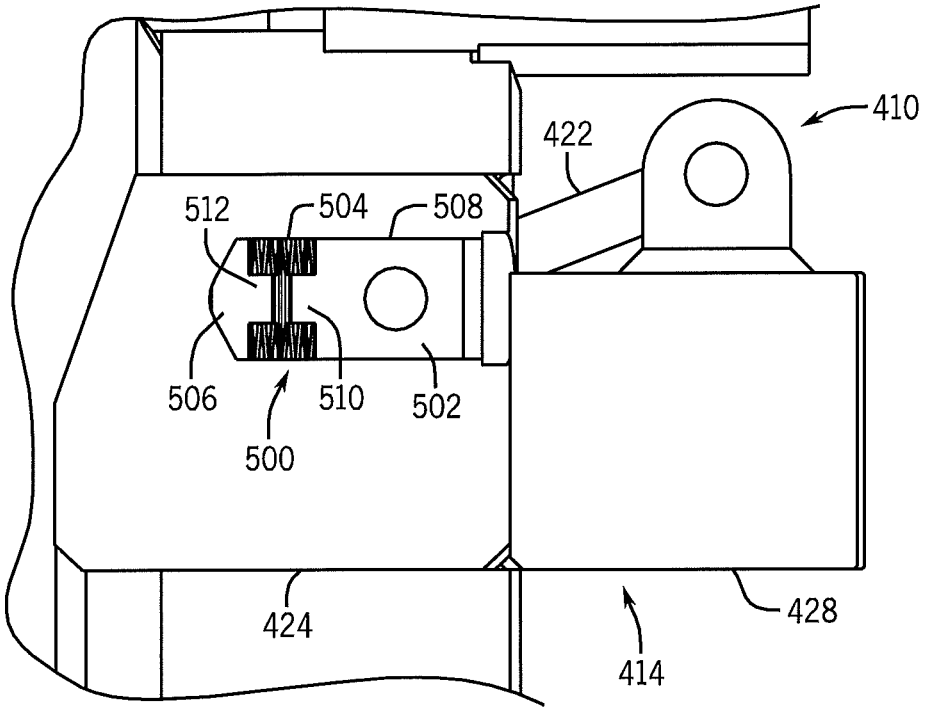
FIG. 12 is a cross-sectional view of an elevator and a portion of an elevator support in accordance with present techniques.

In the illustrated embodiment of FIG. 12, the biasing mechanism 500 includes a plunger 502, a spring 504, and a spring seat 506 disposed within a receptacle 508 of the elevator block 424. The plunger 502 is coupled to the link 422 in a hinged fashion and the spring 504 is positioned between the plunger 502 and the spring seat 506, which is positioned in the end of the receptacle 508. Specifically, the spring 504 is positioned about a boss 510 on the plunger 502 and about a boss 512 on the spring seat 506. In the illustrated position, the spring 504 is generally biasing the plunger 502 away from the spring seat 506. The spring 504 may be calibrated such that pressure applied via the elevator actuators 412 can overcome a bias of the spring 504 and allow disengagement of the elevator 410. Specifically, the elevator actuators 412 may be activated to cause the elevator support 414 to move downward from the position illustrated in FIG. 12, which results in an initial pushing of the plunger 502 toward the spring seat 506 by the link 422. Indeed, the pressure on the plunger 502 may be sufficient to overcome the bias of the spring 504 and compress the spring 504 the distance between the boss 510 and the boss 512. Once the spring 504 has been sufficiently compressed to allow the link 422 a sufficient range of motion, the base ring 428 can move down and out of alignment with the elevator block 424. This allows activation of the elevator actuators 412 to disengage the gripping device 400 from the drillpipe element 102. However, the spring 504 may also be calibrated such that losing power to the elevator actuators 412, in embodiments that require activation of the elevator actuators 412 to engage the elevator 410, will not result in disengagement of the elevator 410. For example, if the elevator actuators 412 include hydraulic actuators, the spring 504 may be calibrated such that a force applied by the weight of certain components when hydraulic pressure is lost would not be sufficient to overcome the spring 504 and compress it the distance that allows the link 422 to rotate such that the base ring 428 is not blocking the elevator block 424 from retracting from engagement with the drillpipe element 102.

As noted above, present embodiments are directed to establishing an engagement between the gripping device 400 and the drillpipe element 102 that can support a pulling load, a torsional load, and a fluid seal (e.g., mud seal). As indicated above, an initial aspect of establishing such an engagement between the drillpipe element 102 and the gripping device 400 includes engaging the tool joint 116 with the elevators 410 to support the pulling load. After establishing the pulling support with the elevators 410 (or separate elevators), present embodiments include establishing a fluid seal between the gripping device 400 and the drillpipe element 102. Such a seal may be established by a sealing mechanism 600 that shifts sealing components of the sealing mechanism 600 into engagement with the drillpipe face 119 and/or the threads 118. By establishing the seal in accordance with present embodiments, the drillpipe 102 may also be aligned with the gripping device 400 for facilitating later establishment of engagement for torsional load.

In the illustrated embodiment of FIGS. 7 and 9, the sealing mechanism 600 includes a seal piston 602, an upper seal 604 coupled to an upper portion of the seal piston 602, a lower seal 606 coupled with a lower portion of the seal piston 602, and a piston housing 608 that is coupled with the housing 404. In the illustrated embodiment, the seal piston 602 includes a hollow, double rod, double acting piston. The seal piston 602 generally includes an elongate hollow body 610 that extends through the piston housing 608, which essentially functions a component of an actuator for the seal piston 602. Indeed, an upper end of the seal piston 602 extends through an upper opening 612 in the piston housing 608 and a lower end of the piston 602 extends through a lower opening 614 in the piston housing 608. Accordingly, the seal piston 602 can slide the lower seal 606 downward into engagement with the drillpipe element 102.

The seal piston 602 may be actuated by pressure. For example, an actuator may provide hydraulic pressure via an upper port 616 into the piston housing 608 such that pressure is increased on an upper side of a lip 618 of the seal piston 602 within the piston housing 608. This may force the seal piston 602 downward and correspondingly flush fluid out of a second port 620 accessing the piston housing 608 that is below the lip 618. In turn, this actuation of the seal piston 602 may cause the lower seal 606 to move relative to the housing 404 and to engage a drillpipe element 102 positioned in the gripping device 400. This type of actuation is illustrated by the transition shown between FIGS. 7 and 9. In FIG. 7, the seal piston 602 has not been positioned for engagement (e.g., no hydraulic pressure has been applied above the lip 618). In FIG. 9, the seal piston 602 has been positioned downward relative to the position shown in FIG. 7 and the lower seal 606 is engaging the drillpipe element 102.

Pressure may also be applied to the seal piston 602 by fluid (e.g., mud) passing through the gripping device 400 to the drillpipe element 102. Specifically, for example, mud coming from above the gripping device 400 may press on the upper seal 604. Pressure on the upper seal 604 may not be sufficient pressure to actuate the seal piston 602 in some embodiments. However, it may serve to preload the seal piston 602 for actuation by a separate actuator (e.g., a hydraulic actuator). Further, because the surface of the upper seal 604 exposed to pressure from fluid is larger than the surface of the lower seal 606 exposed to pressure from fluid, the seal piston 602 will generally be energized downward under fluid pressure (e.g., mud pressure). This may force the lower seal 606 against the drillpipe element 102 to prevent leakage in the event that an actuator for the seal piston 602, such as a hydraulic actuator, loses energy (e.g., pressure).

The upper seal 604 and the lower seal 606 may be integral with or attachable with the seal piston 602. Further, the upper seal 604 and the lower seal 606 may include numerous different seal features and combinations of seal features in accordance with present embodiments. The upper seal 604 illustrated in FIGS. 7 and 9 includes a main body 624 that is coupled about an outer perimeter of the seal piston 602 and a hydraulic rod lip seal 626 integrated with or installed in the main body 624. The lower seal 606 illustrated in FIGS. 7 and 9 includes a main body 630 coupled about an outer perimeter of the seal piston 602 and a pair of O-rings (FIG. 13) integrated with or installed in the main body 630 that are arranged to engage the drillpipe face 119. In some embodiments, one or more O-rings may be employed to create a labyrinth. Further, the O-rings may include commercially available O-rings and may be made of any of various different materials (e.g., rubber, metal, plastic, or nitrile).

Figure 13:
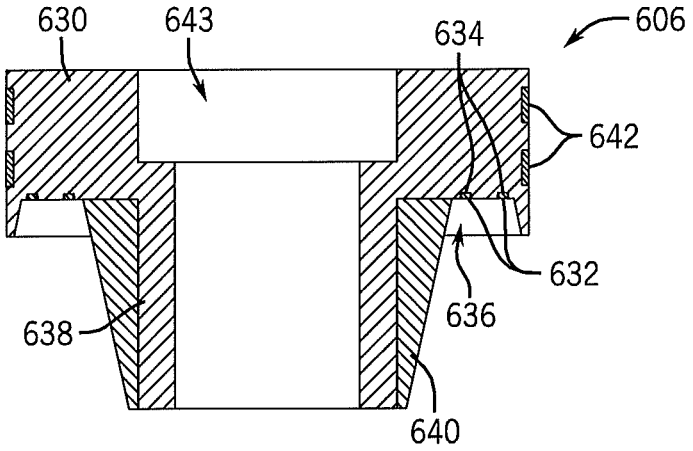
FIGS. 13-18 are cross-sectional views of seal features in accordance with present techniques.

Certain features of the lower seal 606 are more clearly illustrated in FIG. 13, which is a cross-sectional view of the lower seal 606. As shown in FIG. 13, the main body 630 includes the O-rings 632 disposed within grooves 634 in the main body 630 and a larger groove 636 for receiving the drillpipe element 102. The main body 630 also includes a neck portion 638 that is configured to extend within the drillpipe element 102 when the lower seal 606 engages the drillpipe element 102. Disposed about the neck portion 638 is a thread engaging feature 640 for engaging and protecting the threads 118. The thread engaging feature 640 may be made of any suitable material (e.g., urethane, steel, or brass). In the illustrated embodiment, the thread engaging feature 640 is generally frustum-shaped to facilitate engagement and alignment with the drillpipe element 102. In some embodiments, the neck portion 638 itself may be frustum-shaped or the thread engaging feature 640 may be an integral portion of the main body 630. Further, the thread engaging feature 640 may be any of various different shapes or completely absent in certain embodiments. It should be noted that the illustrated thread engaging feature 640 does not create a threaded coupling or engagement with the threads 118. As shown in FIG. 13, the lower seal 606 also includes alignment guides 642, which may be formed of a material such as Teflon. Further, the lower seal 606 in the embodiment illustrated by FIG. 13 includes a threaded receptacle 643 for coupling with the seal piston 602.

Figure 14:
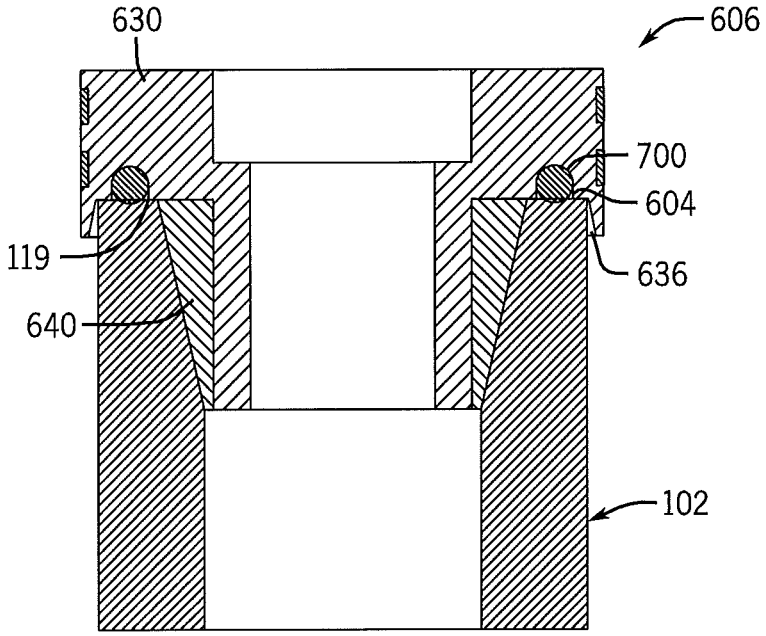
Figure 15:
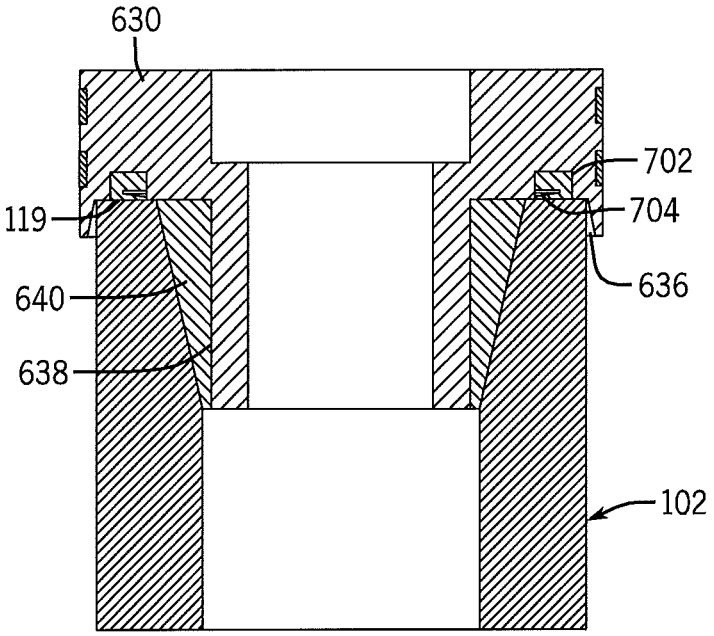

It should be noted that numerous different seal features could be employed in accordance with present embodiments. For example, FIGS. 14-18 include various examples of seals that may be employed as the lower seal 606. Any combination of the seal features illustrated in FIGS. 14-18 may be utilized in the lower seal 606 and/or portions may be utilized in the upper seal 604. Specifically, turning to the examples provided in FIGS. 14-18, the lower seal 606 illustrated in FIG. 14 includes a single crush O-ring 700 engaged within a single groove 604 in the main body 630 and generally being crushed between the drillpipe face 119 and the main body 630 to establish a seal. The embodiment illustrated in FIG. 15 is similar to that of FIG. 14 with the crush O-ring 700 replaced by a hydraulic face lip seal 702, which includes a lip portion 704 that allows pressure to get inside to generate a seal.

Figure 16:
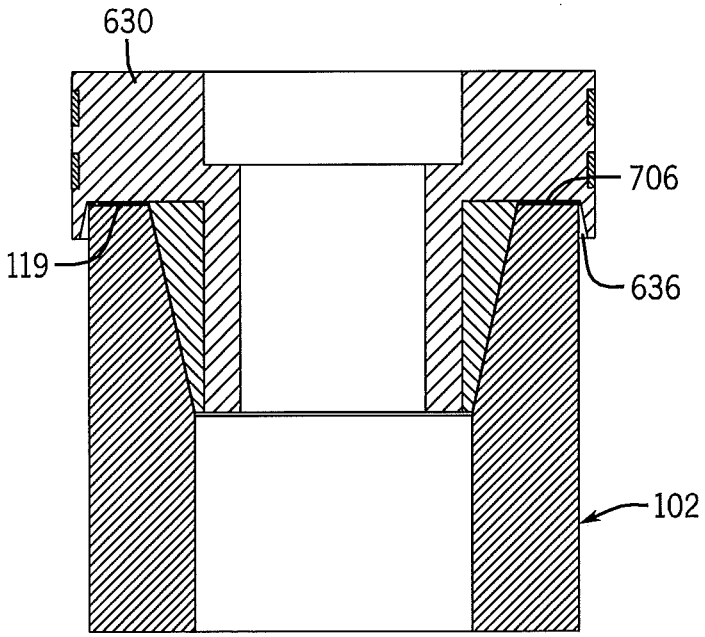

In the embodiment illustrated by FIG. 16, a crush gasket 706 (e.g., an aluminum, copper, or rubber gasket) is positioned between the drillpipe face 119 and the main body 630 within the groove 636 to create a seal. In some embodiments, the crush gasket 706 may represent pipe dope. Further, in some embodiments, the pipe dope may be injected with an automated injection system (e.g., a pump and tubing integral with the gripping device 400 and configured to inject pipe dope in the groove 636).

Figure 17:
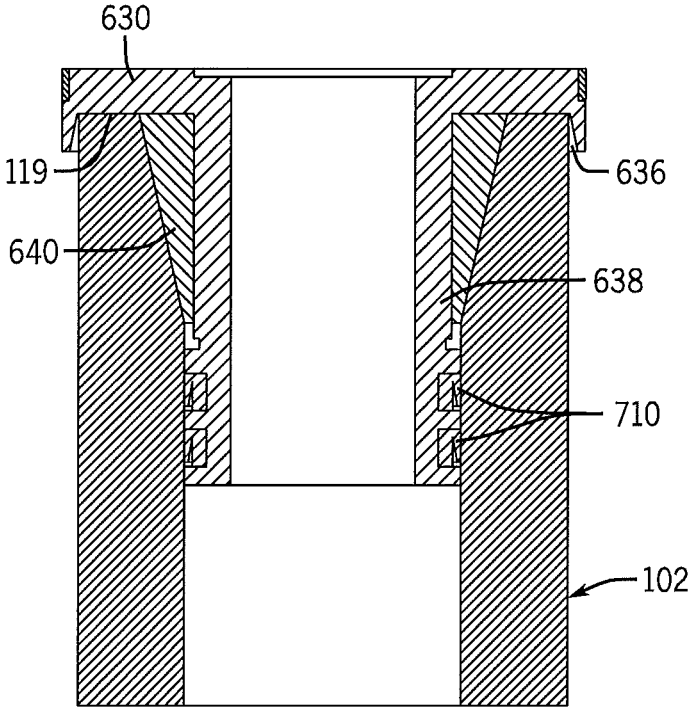
Figure 18:
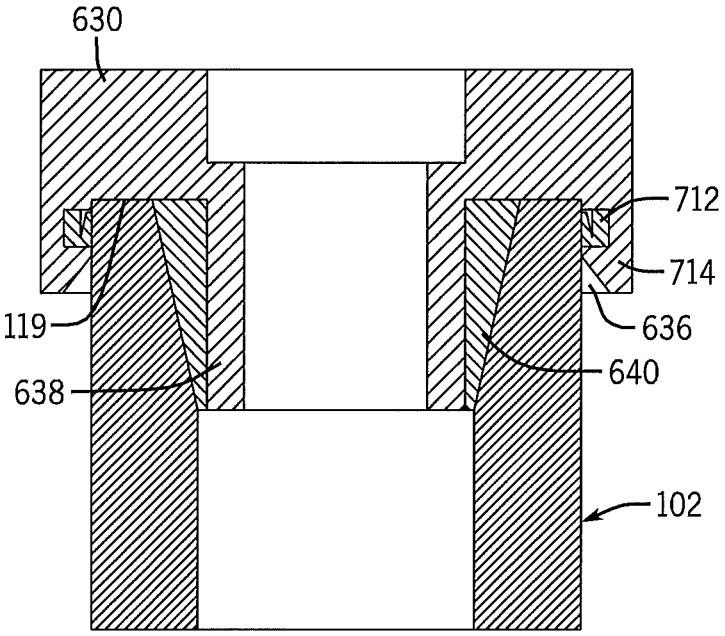

FIGS. 17 and 18 illustrate seal features that specifically engage the drillpipe 102 at locations other than at the drillpipe face 119. The embodiment illustrated by FIG. 17 includes a neck portion 638 that extends beyond the thread engaging feature 640 and includes hydraulic piston lip seals 710 arranged to engage the inside diameter of the drillpipe 102. The embodiment illustrated by FIG. 18 includes a hydraulic rod lip seal 712 positioned in a groove within a lip 714 of the main body 630 such that the hydraulic rod lip seal 712 is configured to engage an outer diameter of the drillpipe 102. As noted above, the features illustrated in FIGS. 13-18 may be included in any combination to facilitate establishing a seal between the gripping device 400 and the drillpipe element 102.

Again, present embodiments are directed to establishing an engagement between the gripping device 400 and the drillpipe element 102 that can support a pulling load, a torsional load, and a fluid seal. Establishing support for a pulling load has been discussed above with respect to the elevators 410. Further, establishing a fluid seal has been discussed above with respect to the sealing mechanism 600. By establishing the seal in accordance with present embodiments, the drillpipe 102 may also be aligned with the gripping device 400 to facilitate establishing engagement for supporting torsional load. Support for the torsional load may be provided by activating the torsional clamping actuators 416 (e.g., hydraulic cylinders), which are configured to actuate frictional engagement features 800, as illustrated in FIGS. 7 and 9, into engagement with the drillpipe element 102. FIG. 7 illustrates the frictional engagement features 800 in a disengaged position and FIG. 9 illustrates the frictional engagement features 800 in an engaged position. This aspect of the gripping device 400 operates in a fashion similar to a grabber box.

In the illustrated embodiment, the frictional engagement features 800 include die clamps 802 (torsional pipe clamps) that are configured to be activated by the torsional clamping actuators 416 to radially engage the drillpipe element 102 when it is disposed within the housing 404 and aligned with the engagement features 800. The frictional engagement features 800 and torsional clamping actuators 416 may generally be referred to together as torsional clamp devices. Once the frictional engagement features 800 are sufficiently engaging the drillpipe element 102, torque can be transferred from the gripping device 400 to the drillpipe element 102 via the frictional engagement features 800. It should also be noted that the torsional clamping actuators 416 may include hydraulic actuators with counter balance valves and/or valving configurations to resist pressure loss and ensure that a sufficient engagement is maintained between the frictional engagement features 800 and the drillpipe element 102 even when there is a loss of actuation energy (e.g., pressure leakage or loss of power).

As illustrated in FIGS. 6 and 8, the gripping device 400 may include a control feature 880 in accordance with present embodiments. The illustrated control feature 880 may be representative of one or more devices configured to facilitate monitoring and/or control of certain operational features of the gripping device 400. The control feature 880 may include a processor and integral sensors. In some embodiments, the control feature may be configured to cooperate with external sensors to detect certain operational characteristics. In the illustrated embodiment, the control feature 880 is centrally located and detects sensor readings from sensors (not shown) throughout the gripping device 400. However, in some embodiments, the control feature 880 may include multiple devices that are located proximate sensors throughout the gripping device 400.

The control feature 880 may be representative of any number of devices capable of monitoring relevant drilling parameters. The monitored drilling parameters may include drill string speed and rotational orientation, vibration and whirl, absolute and relative height of features within a derrick, pressures, temperatures, flow velocities, mud viscosity, mass flow, density, water content, plug detection, pig or ball status, hydraulic circuit pressure at any point in circuits, and so forth. As an example, the control feature 880 may cooperate or include strain sensitive devices (e.g., metal foil or semiconductor strain gauges) applied to the body of the gripping device 400 to measure lifting load, torque load, bending force, mud pressure, or the like. The control feature 880 may be configured to indicate the passage of the drillpipe element 102 into the gripping device 400 such that an actuation sequence in activated upon full insertion. The control feature 880 may include a detection mechanism (e.g., a mechanical switch, optical device, ultrasonic sensor, or hall effect sensor) that is contact-based or non-contact-based. Specifically, for example, the control feature 880 may determine that the pipe upset has been sufficiently inserted into the gripping device 400 and then trigger closing of the elevators 410, actuation of the sealing mechanism 600, and initiation of the torsional clamping actuators 410.

Figure 19:
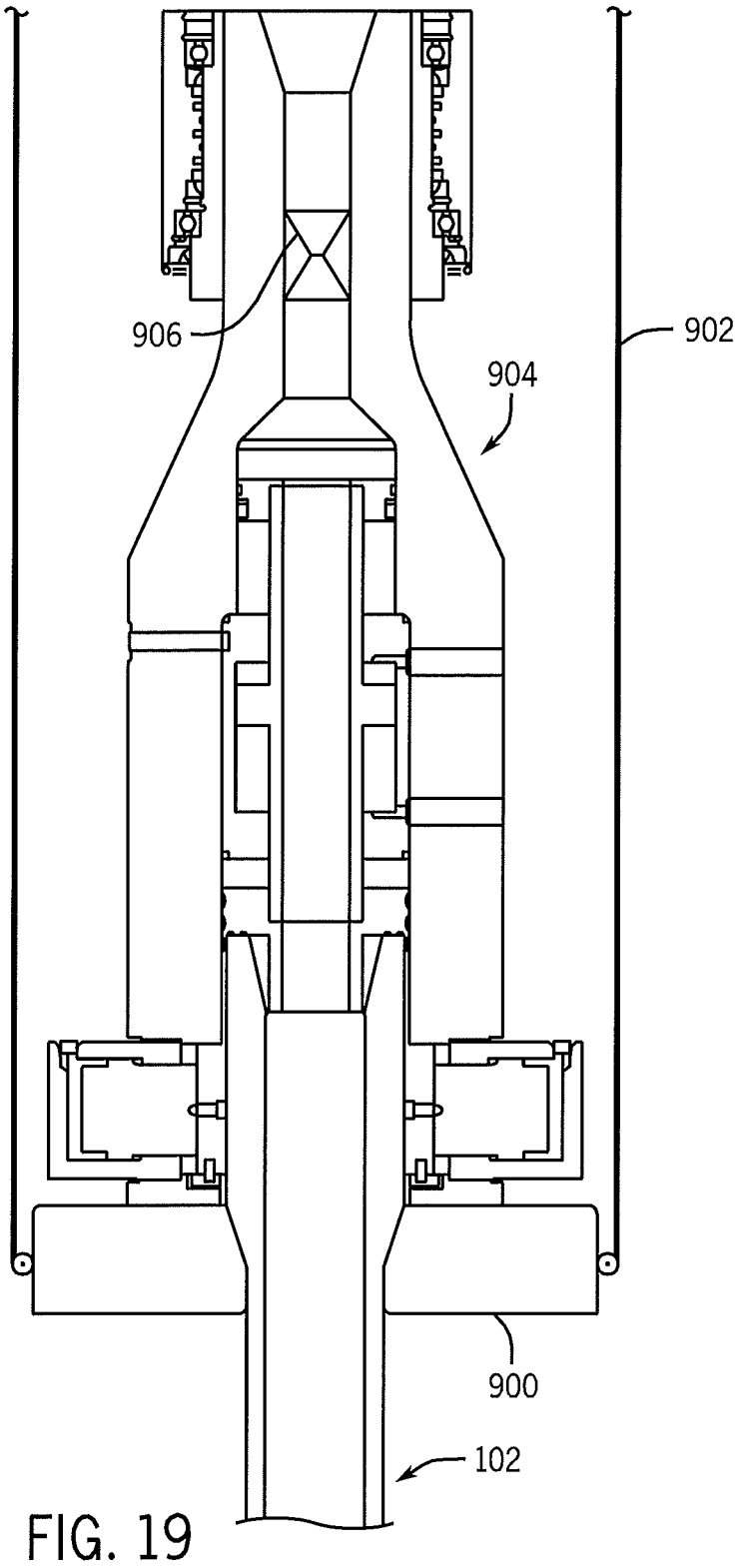
FIG. 19 is a cross-sectional view of a gripping device and a separate elevator mechanism in accordance with present techniques.

While the embodiments illustrated and discussed above with respect to FIGS. 6-11 represent embodiments of the gripping device 400 including integral elevators 410, some embodiments may not include an integral elevator. For example, FIG. 19 illustrates an embodiment wherein a separate elevator 900 on a linkage 902 may be used to couple with the drillpipe element 102 and bring the drillpipe element 102 into engagement with a gripping device 904 that excludes the integral elevators 410, but includes other features of the gripping device 400 illustrated in FIGS. 6-11. Utilizing the separate elevator 900 (e.g., a conventional elevator separate from the gripping device) may facilitate coupling with the drillpipe element 102 while the drillpipe element 102 is laying horizontally.

It should also be noted that FIG. 19 illustrates an integrated valve 904 that is representative of a valve that can be utilized to prevent dumping of stored fluid (e.g., mud) or as a blow out preventer. A valve, such as the integrated valve 904, may be employed in various locations in a gripping device (e.g., 400, 904) in accordance with present embodiments to avoid undesired flow of fluid into the drillpipe element 102 or out of the gripping device. Actuation of the valve may be controlled via integral features of the gripping device, such as the control feature 880.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A pipe drive system, comprising:

a gripping device configured to couple with a pipe element;

a housing of the gripping device configured to extend over and at least partially around a distal end of the pipe element;

torsional clamp devices configured to engage an outer circumferential surface of the pipe element with frictional engagement features that extend radially inward from the housing;

a sealing mechanism configured to shift a pipe seal relative to the housing and into engagement with an axial face of the distal end of the pipe element relative to a longitudinal axis of the pipe element and facilitate fluid flow through the gripping device into the pipe element;

integral elevators configured to radially engage an outer circumferential and conical area of a tool joint of the pipe element to establish support for a pulling load without establishing a threaded engagement with threads of the pipe element; and an elevator support hingedly coupled to links of the integral elevators and configured to move along a rotational axis of the gripping device into a position adjacent elevator blocks of the integral elevators, wherein the links are configured to translate motion of the elevator support into radial motion of the elevator blocks.

2. The system of claim 1, wherein the integral elevators comprise biasing mechanisms configured to compress due to actuation pressure of an elevator actuator to facilitate rotation of the links beyond toggle and extension of the elevator blocks into the housing, wherein the biasing mechanisms are further configured to expand to maintain a locked position with respect to the elevator support.

3. The system of claim 1, wherein the sealing mechanism comprises a seal piston partially disposed within a piston housing and configured to be linearly actuated along a rotational axis of the gripping device.

4. The system of claim 3, wherein the seal piston comprises an upper seal coupled or integral with an upper portion of the seal piston and a lower seal coupled or integral with a lower portion of the seal piston.

5. The system of claim 3, wherein the seal piston comprises a hollow, double rod, double acting piston.

6. The system of claim 1, wherein the sealing mechanism comprises a hollow filler neck, wherein the filler neck is configured to be actuated to extend into the pipe element when the distal end of the pipe element is disposed and held within the housing of gripping device.

7. The system of claim 6, comprising a thread engaging feature disposed about the filler neck and configured to engage thread of the pipe element.

8. The system of claim 1, comprising a valve disposed within the housing and configured to control fluid flow through the gripping device.

9. The system of claim 1, comprising at least one hydraulic actuator configured to actuate the torsional clamp devices.

10. The system of claim 1, comprising at least one hydraulic actuator configured to actuate the sealing mechanism.

11. The system of claim 1, comprising a control feature configured to monitor operational parameters of the gripping device.

12. A pipe drive system, comprising:

a gripping device configured to couple with a pipe element;

a housing of the gripping device comprising a cavity configured to receive a distal end of the pipe element;

integral elevators configured to radially engage an outer circumferential area and conical area of a tool joint of the pipe element to establish support for a pulling load without establishing a threaded engagement with threads of the pipe element;

a sealing mechanism within the gripping device, the sealing mechanism configured to shift a pipe seal relative to the housing and into engagement with an axial face of the distal end of the pipe element relative to a longitudinal axis of the pipe element, wherein engagement of the pipe seal with the pipe element establishes a sealed engagement between the gripping device and the pipe element to facilitate fluid flow between the gripping device and the pipe element;

torsional clamp devices within the gripping device, the torsional clamping devices configured to engage an outer circumferential surface of the pipe element with frictional engagement features that extend radially inward from the housing to establish support for a torsional load after the sealed engagement is established and an elevator support hingedly coupled to links of the integral elevators and configured to move along a rotational axis of the gripping device into a position adjacent elevator blocks of the integral elevators, wherein the links are configured to translate motion of the elevator support into radial motion of the elevator blocks.

13. The system of claim 12, wherein the sealing mechanism comprises a hollow neck extension that is configured to slide into the pipe element to facilitate establishing the sealed engagement and to facilitate aligning the pipe element with a rotational axis of the gripping device.

14. The system of claim 12, wherein the gripping device is integral with or configured to be coupled to a quill of a top drive.

15. The system of claim 12, comprising a control feature configured to monitor and control operational parameters of the gripping device.

16. A pipe drive system, comprising:

a gripping device configured to couple with a pipe element;

a housing of the gripping device configured to extend over and at least partially around a distal end of the pipe element;

torsional clamp devices configured to engage an outer circumferential surface of the pipe element with frictional engagement features that extend radially inward from the housing; and a sealing mechanism configured to shift a pipe seal relative to the housing and into engagement with an axial face of the distal end of the pipe element relative to a longitudinal axis of the pipe element and facilitate fluid flow through the gripping device into the pipe element, wherein the sealing mechanism comprises a seal piston partially disposed within a piston housing and configured to be linearly actuated along a rotational axis of the gripping device, and wherein the seal piston comprises one or both of:

an upper seal coupled or integral with an upper portion of the seal piston and a lower seal coupled or integral with a lower portion of the seal piston; and a hollow, double rod, double acting piston.

* * * * *